US009343246B2

(12) United States Patent
Inagaki et al.

(10) Patent No.: US 9,343,246 B2
(45) Date of Patent: May 17, 2016

(54) TRIGGER SWITCH

(71) Applicant: Satori S-Tech Co., Ltd., Tokyo (JP)

(72) Inventors: Isao Inagaki, Kanagawa (JP); Ippei Kino, Kanagawa (JP)

(73) Assignee: SATORI S-TECH CO., LTD., Tokyo (JP)

( * ) Notice: Subject to any disclaimer, the term of this patent is extended or adjusted under 35 U.S.C. 154(b) by 36 days.

(21) Appl. No.: 14/447,844

(22) Filed: Jul. 31, 2014

(65) Prior Publication Data

US 2015/0041295 A1 Feb. 12, 2015

(30) Foreign Application Priority Data

Aug. 8, 2013 (JP) ..... 2013-164982

(51) Int. Cl.
*H01H 13/06* (2006.01)
*H01H 9/04* (2006.01)
*H01H 13/00* (2006.01)

(52) U.S. Cl.
CPC ..... *H01H 13/063* (2013.01); *H01H 9/047* (2013.01); *H01H 13/00* (2013.01); *H01H 13/06* (2013.01)

(58) Field of Classification Search
CPC ..... H01H 13/06; H01H 3/00; H01H 3/02; H01H 3/0206; H01H 3/12; H01H 5/00; H01H 5/06; H01H 5/08; H01H 9/04; H01H 9/041; H01H 13/00; H01H 13/02; H01H 13/04; H01H 13/063; H01H 13/10; H01H 13/12; H01H 13/14; H01H 13/20; H01H 13/28; H01H 13/32; H01H 13/50; H01H 13/52; H01H 13/705; H01H 2003/00; H01H 2003/02; H01H 2003/12; H01H 2009/02; H01H 2009/0278; H01H 2009/04; H01H 2009/048; H01H 2013/00; H01H 2013/04; H01H 2013/06; H01H 2013/50; H01H 2013/52; H01H 2223/00; H01H 2223/044; H01H 2223/046; H01H 2223/048
USPC ..... 200/302.2, 302.1, 302.3, 333, 332.2, 200/505, 520, 323, 325, 341
See application file for complete search history.

(56) References Cited

U.S. PATENT DOCUMENTS

2011/0168420 A1 7/2011 Kobayashi et al.
2012/0160649 A1 6/2012 Hwang et al.

(Continued)

FOREIGN PATENT DOCUMENTS

JP 36-016340 6/1961
JP 2-8826 1/1990

(Continued)

OTHER PUBLICATIONS

Extended European Search Report issued Dec. 12, 2014 in European Patent Application No. 14178800.0.
Japanese Office Action issued Jul. 27, 2015 in corresponding Japanese Patent Application No. 2013-164982 with English translation.

*Primary Examiner* — Renee S Luebke
*Assistant Examiner* — Anthony R. Jimenez
(74) *Attorney, Agent, or Firm* — Wenderoth, Lind & Ponack, L.L.P.

(57) ABSTRACT

Disclosed a trigger switch including: a case having a switch chamber in which a switch mechanism is arranged in a sealed state; a plunger inserted slidably into a shaft hole formed on one end side of the case, coupled to the switch mechanism, and biased forward; and a trigger provided on a distal end of the plunger for operating the switch, wherein the switch mechanism includes an air pressure stabilizing mechanism configured to cancel an air compressing action in the interior of the switch chamber caused by the switch mechanism moving in the interior of the switch chamber. The air pressure stabilizing mechanism includes a communication hole extending from a rear end opening facing the switch chamber to a distal end opening on the plunger, and a plunger-engaging portion of the trigger includes a discharge port communicating with the communication hole and configured to release air from the communicating hole.

7 Claims, 5 Drawing Sheets

(56) References Cited

U.S. PATENT DOCUMENTS

| | | | |
|---|---|---|---|
| 2013/0140167 | A1 | 6/2013 | Kobayashi |
| 2014/0202277 | A1 | 7/2014 | Hozumi et al. |

FOREIGN PATENT DOCUMENTS

| | | |
|---|---|---|
| JP | 2005-203290 | 7/2005 |
| JP | 2011-065767 | 3/2011 |
| JP | 2011-146197 | 7/2011 |
| JP | 2013-054310 | 3/2013 |

TRIGGER SWITCH

BACKGROUND OF THE INVENTION

1. Field of the Invention

The present invention relates to a trigger switch to be mounted on an electric tool such as an electric drill.

2. Prior Art

A trigger switch in the prior art includes a case having a switch mechanism integrated therein, a cover configured to seal the case, and a trigger provided outside for driving the switch mechanism. The trigger and the switch mechanism are coupled by a plunger, and a switch is turned ON and OFF by moving the plunger in and out. The switch mechanism in the interior of the case is arranged in a sealed space. When the trigger is retracted, the plunger coupled thereto is retracted correspondingly, whereby the switch is turned ON (see JP-A-2013-54310).

However, in the trigger switch of the prior art, the switch of an electric tool or the like has the trigger that reciprocates for driving the electric tool. Therefore, even though using an adhesive agent or the like seals the case and the cover, dust or moisture may enter the interior of the switch when the switch is operated.

Even though the case and the cover, which constitute part of the body of the switch, are sealed with the adhesive agent or the like, since there is no way to escape in the interior of the switch and hence air can hardly move when the trigger is reciprocated, a switching action may be adversely affected.

SUMMARY OF THE INVENTION

Therefore, there is a problem to be solved in providing a trigger switch having high dust-proof properties and water-proof properties by resolving an influence of movement of air in the interior of the switch when the trigger is operated.

In order to solve the above-described problem, the application of the invention provides a trigger switch including: a case having a switch chamber in which a switch mechanism is arranged in a sealed state; a plunger inserted into a shaft hole formed on one end side of the case so as to be freely slidable and coupled to the switch mechanism which is biased forward; and a trigger used for operating the switch by engaging and locking a distal end of the plunger, wherein the switch mechanism includes an air pressure stabilizing mechanism configured to cancel an air compressing action in the interior of the switch chamber caused by the switch mechanism moving in the interior of the switch chamber.

Preferably, the air pressure stabilizing mechanism includes a communication hole extending from a rear end opening facing the switch chamber to a distal end opening on the plunger, and a plunger-engaging portion of the trigger includes a discharge port communicating with the communication hole and configured to release air from the communicating hole.

Preferably, a spherical ball is provided in the interior of the communication hole in terms of dust proof, and a thin film sheet configured to allow air to pass therethrough and block moisture and dust is arranged at an end of the communication hole.

Preferably, the air pressure stabilizing mechanism includes an air discharge chamber adjacent to the switch chamber, which communicating with outside air, an communication port penetrating through a partitioning wall configured to partition the air discharge chamber and the switch chamber, and an elastic thin film sheet closing the communication port.

Preferably, the thin film sheet may be an elastic member configured to be expanded like a balloon.

Preferably, the air pressure stabilizing mechanism includes a dummy shaft having substantially the same radial cross-sectional area as the plunger, and a dummy shaft hole formed in a rear end side wall of the switch chamber and configured to allow insertion of the dummy shaft so as to be freely slidable, and the dummy shaft includes one end coupled to the switch mechanism and the other end inserted into the dummy shaft hole and configured to protrude freely out from the switch chamber in conjunction with the movement of the switch mechanism.

The trigger switch of the invention includes the air pressure stabilizing mechanism configured to cancel the air compressing action in the switch chamber caused by the movement of the switch mechanism in the switch chamber. Therefore, impairment of smoothness of an operation due to a change in air pressure in the switch chamber is prevented and entry of dust and moisture is prevented.

The communication hole extending from the rear end opening facing the switch chamber to the distal end opening is provided on the plunger, and the plunger-engaging portion of the trigger is provided with the discharge port communicating with the communication hole and configured to release air from the communication hole. Therefore, air in the interior of the switch mechanism is pushed out through the communication hole, so that the change in air pressure of the switch mechanism may be restrained, and entry of dust and moisture due to the change in air pressure may be prevented.

With the configuration in which the ball is arranged in the interior of the communication hole of the plunger, dust and moisture contained in air flowing through the communication hole may be blocked.

In addition, with the configuration of the thin film sheet provided at the end of the communication hole, dust and moisture entering the interior of the communication hole is blocked further reliably.

With the configuration in which the air discharge chamber provided adjacently with the switch chamber and communicating with outside air is provided, the communication port configured to penetrate through the partitioning wall that partitions the air discharge chamber and the switch chamber is formed, and the thin film sheet formed of an elastic member configured to close the communication port is arranged, air pressure in the switch chamber may be received by the thin film sheet, and air pressure generated by the movement of the switch mechanism may be released.

Furthermore, with the configuration in which a dummy shaft having substantially the same radial cross-sectional area as the plunger, and a dummy shaft hole formed in a rear end side wall of the switch chamber and configured to allow insertion of the dummy shaft so as to be freely slidable are provided so that the dummy shaft is configured to protrude freely out from the switch chamber in conjunction with the movement of the switch mechanism, an amount of air and air pressure in the interior of the switch chamber may be maintained constant even though the switch mechanism moves in the interior of the switch chamber.

DETAILED DESCRIPTION OF THE PREFERRED EMBODIMENTS

Figure 1:
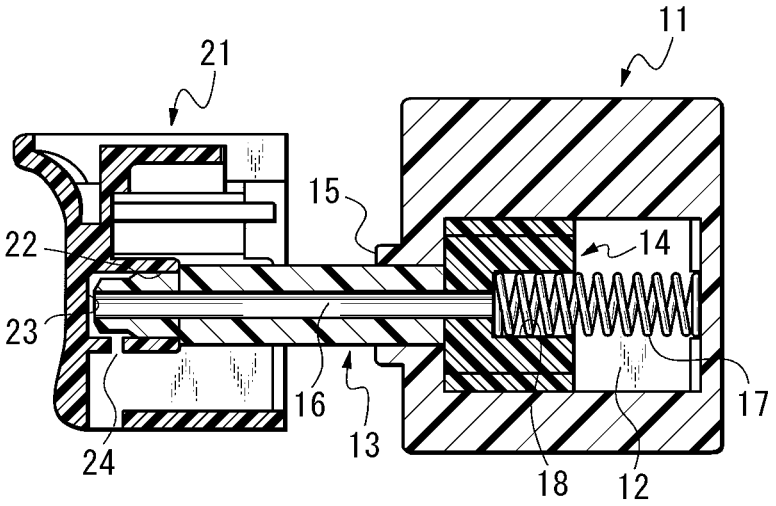
FIG. 1 is a cross-sectional side view schematically illustrating a trigger switch according to a first embodiment of the invention.

Referring now to the drawings, embodiments of a trigger switch of the invention will be described.

The invention provides a trigger switch including: a case 11 having a switch chamber 12 in which a switch mechanism 14 is arranged in a sealed state; a plunger 13 inserted into a shaft hole 15 formed on one end side of the case 11 so as to be freely slidable and coupled to the switch mechanism 14 which is biased forward; and a trigger 21 used for operating the switch by engaging and locking a distal end of the plunger 13, wherein the switch mechanism 14 includes an air pressure stabilizing mechanism configured to cancel an air compressing action in the interior of the switch chamber caused by the switch mechanism moving in the interior of the switch chamber.

Figure 2:
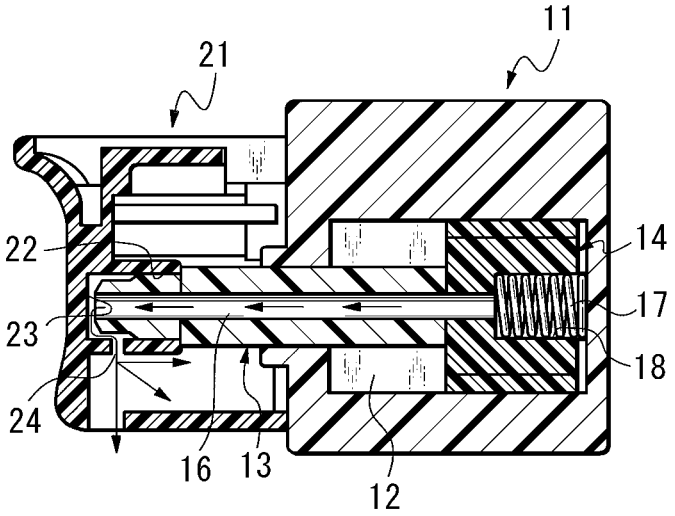
FIG. 2 is a cross-sectional side view illustrating a state in which a trigger of the trigger switch is retracted.

FIG. 1 and FIG. 2 illustrate the trigger switch of a first embodiment of the invention. The sealed switch chamber 12 is provided in the interior of the case 11, and the switch mechanism 14 coupled to the plunger 13 is stored in the switch chamber 12. The plunger 13 extends out from the shaft hole 15 of the case 11, and a distal end portion thereof is engaged and locked with a plunger-engaging portion 22 of the trigger 21 arranged outside the case 11.

The plunger 13 includes a communication hole 16 extending from a rear end opening facing a storage 18 configured to store a restoration spring 17 of the switch mechanism 14 therein and facing the storage 18 to a distal end opening. A distal end portion of the communication hole 16 is engaged and locked with a wall 23 which corresponds to an inner most portion of the plunger engaging portion 22 of the trigger 21 so as to face the wall 23 with a slight gap therebetween. An outer diameter of the distal end portion of the plunger is slightly reduced so as to have a structure which releases air to a discharge port 24 formed on a lower portion on the distal end side of the plunger engaging portion 22 formed into a substantially cylindrical shape.

In the switch configured in this manner, when the plunger 13 is retracted against the restoration spring 17 by an operation of the trigger 21, the switch mechanism 14 in the switch chamber 12 is moved and the plunger 13 moving and thrusting into the chamber compresses air in the switch chamber 12. The compressed air corresponding to the volume of the thrust plunger flows into the communication hole 16 of the plunger 13, air flowed into the communication hole 16 is discharged from an opening at the distal end of the plunger 13 which is engaged and locked with the trigger 21, so that the discharged air is discharged from the discharge port 24 of the trigger 21.

When an operation to restore the retracted trigger 21 to the original position is performed, the switch mechanism 14 of the switch chamber 12 is restored to its original position by the restoration spring 17 and hence there occurs a decompressing action on the air in the switch chamber 12. However, the air corresponding thereto flows through the communication hole 16, and variations in air pressure in the switch chamber 12 are prevented.

As described thus far, air staying in the switch chamber 12 is discharged through the communication hole 16 without being compressed by the movement of the switch mechanism 14, so that an adverse effect of compression and decompression in the switch chamber 12 on a switching operation is eliminated, and entry of dust and moisture through a slight gap is also prevented.

Figure 3:
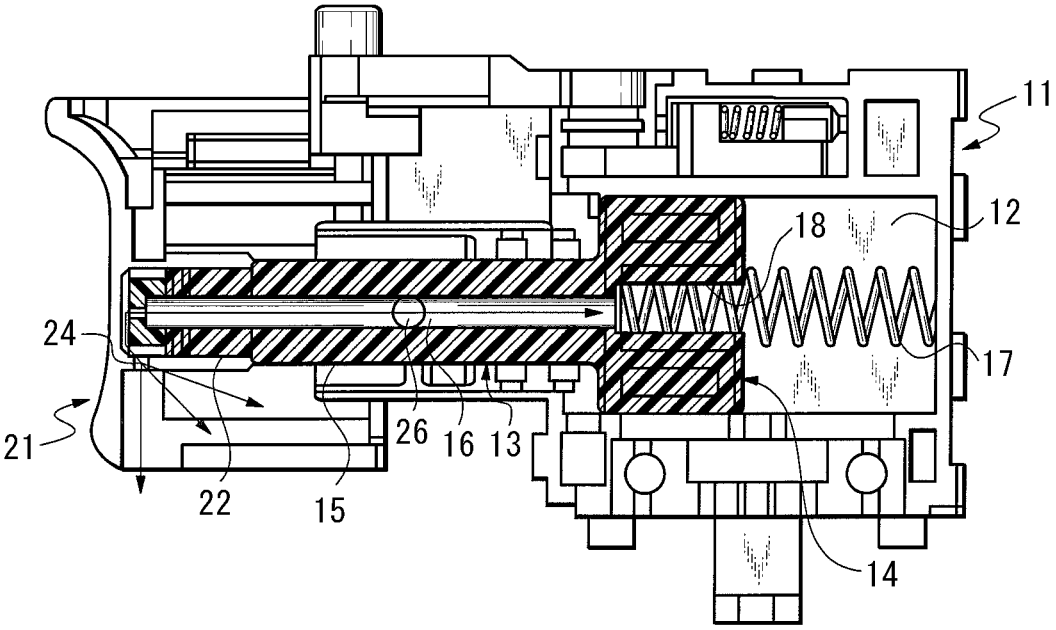
FIG. 3 is a cross-sectional side view schematically illustrating a trigger switch according to a second embodiment of the invention.

FIG. 3 illustrates a trigger switch according to a second embodiment of the invention. The trigger switch of the second embodiment is improved in dust-proof properties and water-proof properties by a configuration in which a ball 26 is arranged in the interior of the communication hole 16 of the hollow plunger 13 in addition to formation of the communication hole 16 in the plunger 13 to make it hollow to form a way for air to escape when the trigger 21 is operated.

The trigger switch includes the sealed switch chamber 12 in the interior of the case 11, and the switch mechanism 14 coupled to the plunger 13 is stored in the switch chamber 12. The plunger 13 extends outward from the shaft hole 15 of the case 11, and the distal end portion thereof is engaged and locked with the plunger-engaging portion 22 of the trigger 21 arranged outside of the case 11.

The plunger 13 includes the communication hole 16 opening at front and rear ends. The rear end side of the communication hole 16 communicates with the storage 18 configured to store the restoration spring 17 of the switch mechanism 14, and a distal end side of the communication hole 16 is engaged and locked with an innermost wall of the plunger-engaging portion 22 of the trigger 21 so as to face the wall. An outer diameter of the distal end portion of the plunger is slightly reduced so as to have a structure which releases air to the discharge port 24 formed on a lower portion on the distal end side of the plunger engaging portion 22 formed into a substantially cylindrical shape. The spherical ball 26 is arranged in the interior of the communication hole 16. The communication hole 16 is formed into a tapered shape at a distal end on the trigger 21 side, so that the ball 26 is prevented from coming off.

In the switch configured in this manner, when the plunger 13 is retracted by an operation of the trigger 21, the switch mechanism 14 in the switch chamber 12 is moved and compresses air in the switch chamber 12. The compressed air corresponding to the volume of the thrust plunger 13 flows into the communication hole 16 of the plunger 13, air flowed into the communication hole 16 presses the ball 26, and the air pressed by the ball is discharged from an opening at the distal end of the plunger 13 which is engaged and locked with the trigger 21, so that the discharged air is discharged from the discharge port 24 of the trigger 21.

When an operation to restore the retracted trigger 21 to the original position is performed, the switch mechanism 14 of the switch chamber 12 is restored to its original position by the restoration spring 17 and hence there occurs a decompressing action on the air in the switch chamber 12. However, the air corresponding thereto flows through the communication hole 16, and the air flowing into the switch chamber 12 while pressing the ball 26 prevents variations in air pressure in the interior of the switch chamber 12.

In this manner, with the ball 26 arranged in the interior of the communication hole 16, dust or water drops passing through the interior of the communication hole 16 are blocked. Specifically, dust or water drops sucked in a state of being mixed with air when the air flows inward from the communication hole 16 when an operation to restore the trigger 21 to its original position is performed may be blocked.

Figure 4:
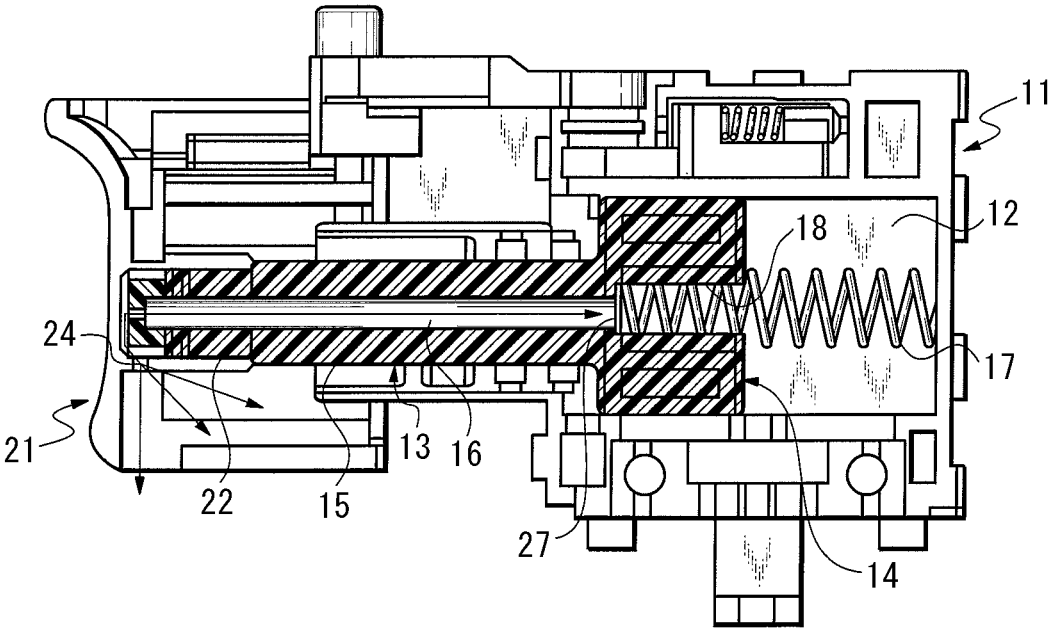
FIG. 4 is a cross-sectional side view schematically illustrating a trigger switch according to a third embodiment of the invention.

Subsequently, the trigger switch according to a third embodiment of the invention illustrated in FIG. 4 will be described. The trigger switch of the third embodiment has a configuration in which dust-proof properties and water-proof properties are further improved by a configuration in which a thin film sheet 27 is arranged at a rear end of the communication hole 16 in addition to formation of the communication hole 16 opening at front and rear ends in the plunger 13 to form a way for air to escape when the trigger is operated.

The configuration of the trigger switch of the third embodiment is substantially the same as that of the second embodiment other than that the thin film sheet 27 is arranged at an end on the switch chamber 12 side of the communication hole 16 instead of arranging the ball in the interior of the communication hole 16 of the plunger 15, and hence detailed description will be omitted. The thin film sheet 27 is formed of a flexible elastic member configured to allow air to pass therethrough and block moisture dust, and is expanded like a balloon in the interior of the communication hole 16 when the trigger 21 is retracted therein.

In the switch configured in this manner, when the plunger 13 is retracted by an operation of the trigger 21, the switch mechanism 14 in the switch chamber 12 is moved and compresses air in the switch chamber 12. The compressed air flows into the communication hole 16 of the plunger 13, air flowed into the communication hole 16 is discharged from an opening at the distal end of the plunger 13 which is engaged and locked with the trigger 21 while expanding the thin film sheet 27 in the interior of the communication hole 16, so that the discharged air is discharged from the discharge port 24 of the trigger 21.

When an operation to restore the retracted trigger 21 to the original position is performed, the switch mechanism 14 of the switch chamber 12 is restored to its original position and hence there occurs a decompressing action on the air in the switch chamber 12. However, the air corresponding thereto flows through the communication hole 16, and variations in air pressure in the interior of the switch chamber 12 are prevented by the air flowing into the switch chamber 12 while restoring the thin film sheet 27 to its original shape by the corresponding air.

In this manner, with the thin film sheet 27 arranged at the end of the communication hole 16, dust or water drops passing through the interior of the communication hole 16 are blocked. Specifically, dust or water drops sucked in a state of being mixed with air when the air flows inward from the communication hole 16 when an operation to restore the trigger 21 to its original position is performed may be blocked. In the third embodiment, the thin film sheet 27 arranged the end of the communication hole 16 allows air to pass therethrough, blocks moisture dust, and is formed of a flexible elastic member. However, the invention is not limited thereto, and any member is applicable as long as it allows air to pass therethrough and blocks moisture dust, and may not be the flexible elastic member. Furthermore, the thin film sheet 27 may be formed of the flexible elastic member that does not allow air to pass therethrough. In this case, the air pressure in the interior of the switch chamber 12 may be maintained constant by configuring the thin film sheet 27 so as to expand like a balloon in the interior of the communication hole 16 when the trigger 21 is retracted.

Figure 5:
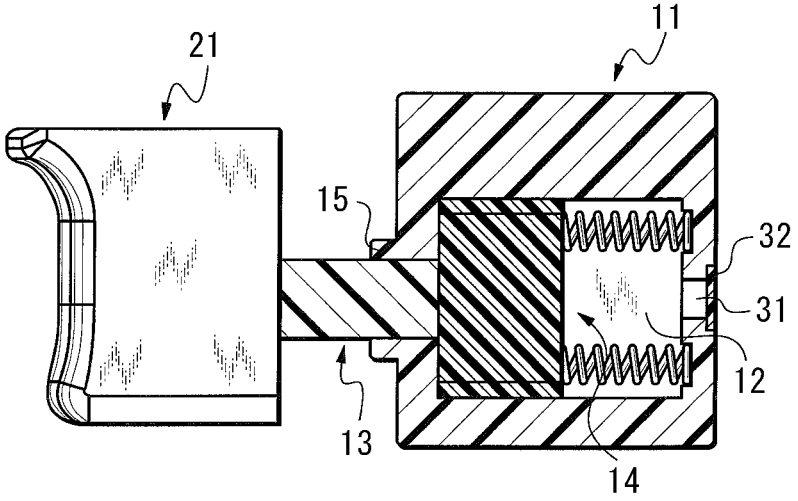
FIG. 5 is a cross-sectional side view schematically illustrating a trigger switch according to a fourth embodiment of the invention.
Figure 6:
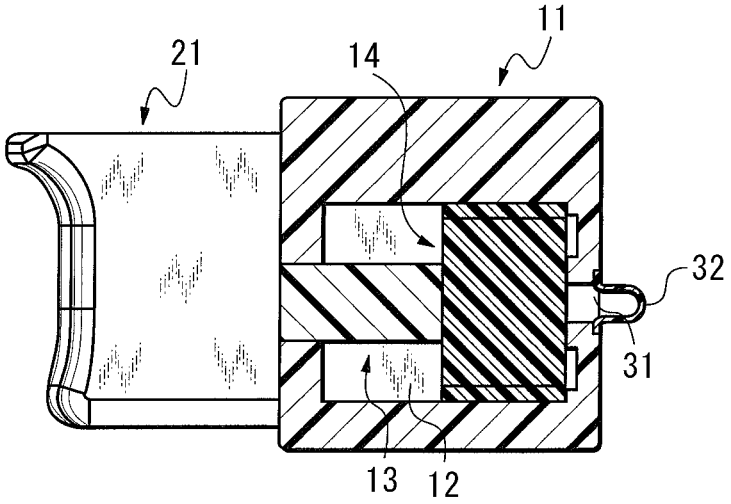
FIG. 6 is a cross-sectional side view illustrating a state in which the trigger of the trigger switch of the fourth embodiment is retracted.

FIG. 5 and FIG. 6 illustrate the trigger switch according to a fourth embodiment of the invention. The trigger switch has a configuration in which a discharge port 31 is formed on a wall on the side opposite to the shaft hole 15 of the plunger in the switch chamber 12, and a thin sheet that closes the discharge port 31 is arranged, so that air staying in the switch mechanism is released by the sheet expanded like a balloon when the trigger 21 makes a full stroke.

The trigger switch includes the sealed switch chamber 12 in the interior of the case 11, and the switch mechanism 14 coupled to the plunger 13 is stored in the switch chamber 12. The plunger 13 extends outward from the shaft hole 15 of the case 11, and a distal end portion thereof is engaged and locked with the trigger 21 arranged outside the case 11. The switch chamber 12 is provided with the discharge port 31 in a wall on the back, and a thin film sheet 32 formed of an elastic member is mounted on the discharge port 31. The thin film sheet 32 used here has a flexibility to an extent that is expanded like a balloon.

In the switch configured in this manner, when the plunger 13 is retracted by an operation of the trigger 21, the switch mechanism 14 in the switch chamber 12 is moved and compresses air in the switch chamber 12. The compressed air compresses and expands the thin film sheet 32 arranged at the discharge port 31 and into the balloon shape, so that the compressed air can be released. Accordingly, variations in air in the switch chamber 12 are restricted.

When an operation to restore the retracted trigger 21 to the original position is performed, the switch mechanism 14 of the switch chamber 12 is restored to its original position and hence there occurs a decompressing action on the air in the switch chamber 12. However, the thin film sheet 32 is restored to its original state to compensate the air corresponding thereto, so that variations in air pressure in the switch chamber 12 are prevented.

Figure 7:
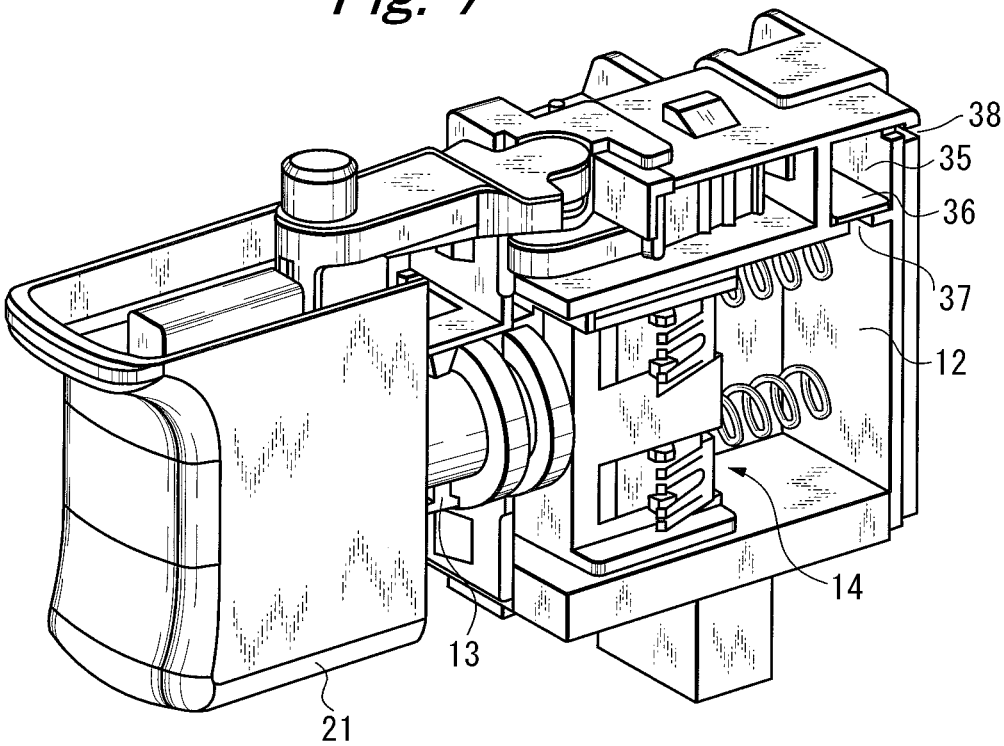
FIG. 7 is a perspective view illustrating a state in which a sidewall of a trigger switch according to a fifth embodiment of the invention is removed.
Figure 8:
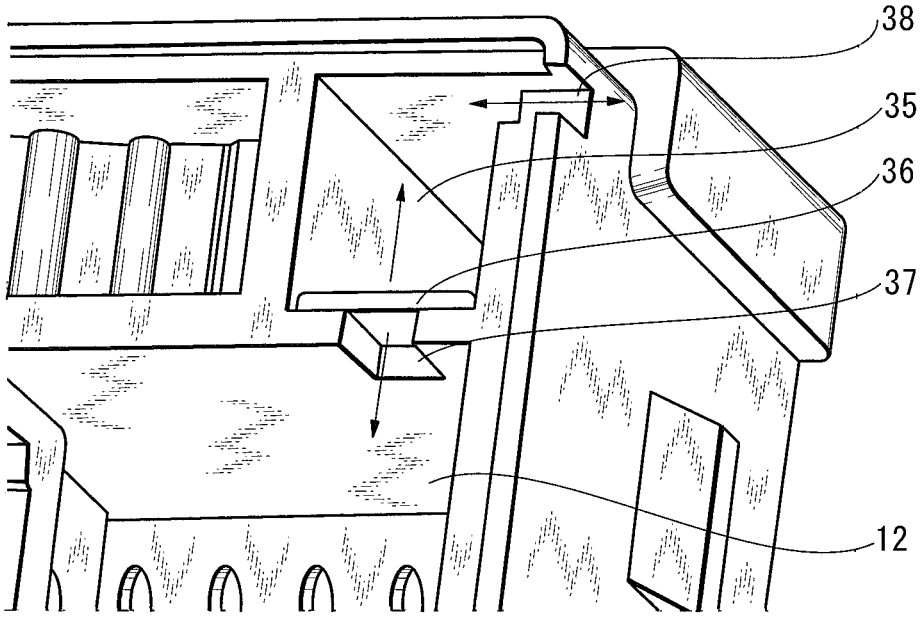
FIG. 8 is an enlarged view illustrating an airflow when the trigger of the trigger switch of the fifth embodiment is retracted.

FIG. 7 and FIG. 8 illustrate the trigger switch according to a fifth embodiment of the invention. The trigger switch has a configuration in which an air discharge chamber 35 having a predetermined space at a position in the interior of the case 11 adjacent to the switch chamber 12, a communication port 37 passing between the air discharge chamber 35 and the switch chamber 12 is formed, the thin film sheet 36 configured to close the communication port 37 is mounted, so that the thin film sheet 36 is expanded like a balloon when a full stroke of the trigger 21 is made to release the air compressed in the switch mechanism 14.

The air discharge chamber 35 having a predetermined space is provided at an upper position adjacent to the switch chamber 12, and communicates with the switch chamber 12 via the communication port 37. An atmospheric air port 38 that comes into contact with atmospheric air is provided in the air discharge chamber 35, and the communication port 37 is closed by the thin film sheet 36. The thin film sheet 36 is capable of expanding like a balloon.

In the switch configured in this manner, when the plunger 13 is retracted by an operation of the trigger 21, the switch mechanism 14 in the switch chamber 12 is moved and compresses air in the switch chamber 12. The compressed air is pushed out toward the air discharge chamber 35, and the thin film sheet 36 is expanded toward the air discharge chamber 35 to release the air. Since the air compressed in the switch chamber 12 can be released toward the air discharge chamber 35, pressure variations of air in the switch chamber 12 are avoided.

When an operation to restore the retracted trigger 21 to the original position is performed, the switch mechanism 14 of the switch chamber 12 is restored to its original position and hence the air in the switch chamber 12 is brought into a decompressed state. However, the thin film sheet 36 expanded toward the air discharge chamber 35 is restored to compensate the air corresponding thereto, so that variations in air pressure in the interior of the switch chamber 12 are prevented.

In the fifth embodiment, the thin film sheet 36 is formed of a flexible member that expands like a balloon. However, the invention is not limited thereto, and the thin film sheet 36 may be formed of a member that does not expand like a balloon, and allows air to pass therethrough and blocks moisture or dust. When the thin film sheet 36 is used, if the trigger 21 is retracted, air in the switch chamber 12 is compressed. Therefore, the compressed air passes through the thin film sheet 36 and flows toward the air discharge chamber 35, and the air flowed therein is discharged from the atmospheric air port 38, whereby pressure variations of compressed air in the switch chamber 12 are avoided. In contrast, when an operation to restore the trigger 21 to its original state is performed, there is a decompressing action on the air in the switch chamber 12, so that the air is sucked from the atmospheric air port 38 into the air discharge chamber 35, and air pressure of the air flowed into the air discharge chamber 35 is prevented from varying owing to air flowing into the switch chamber 12 via the thin film sheet 36. At this time, the thin film sheet 36 allows only air to pass therethrough, and hence moisture dust from the outside can be blocked completely.

In addition, the thin film sheet 36 may be formed of a flexible member that is configured to expand like a balloon, allow air to pass therethrough, and block moisture dust. In this case, when the trigger 21 is operated, and air in the switch chamber 12 is compressed, the thin film sheet 36 expands toward the air discharge chamber 35, and pressure variations in air in the switch chamber 12 are canceled. When an operation to restore the trigger 21 is performed, there is a decompressing action on air in the switch chamber 12, so that the thin film sheet 36 expanded toward the air discharge chamber 35 is restored to its original state, whereby variations in air pressure in the switch chamber is avoided. At this time, the thin film sheet is expanded and then is restored to its original state, entry of moisture or dust due to variations toward the outside is blocked by the thin film sheet 36.

Figure 9:
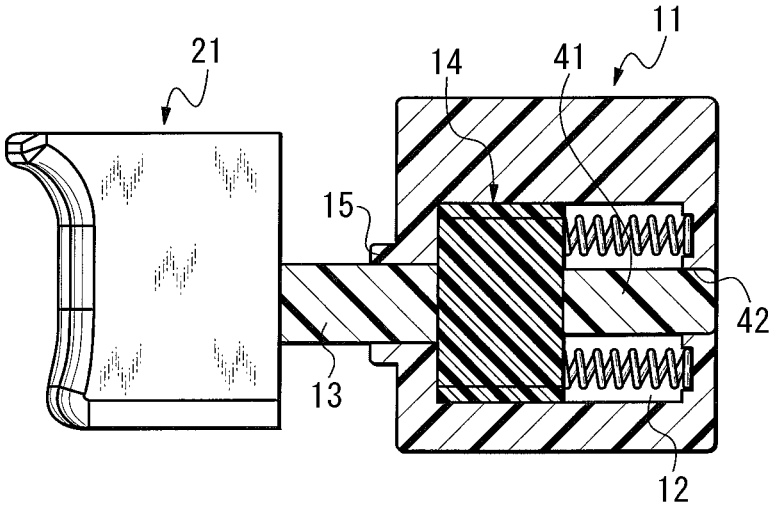
FIG. 9 is a cross-sectional side view schematically illustrating a trigger switch according to a sixth embodiment of the invention.
Figure 10:
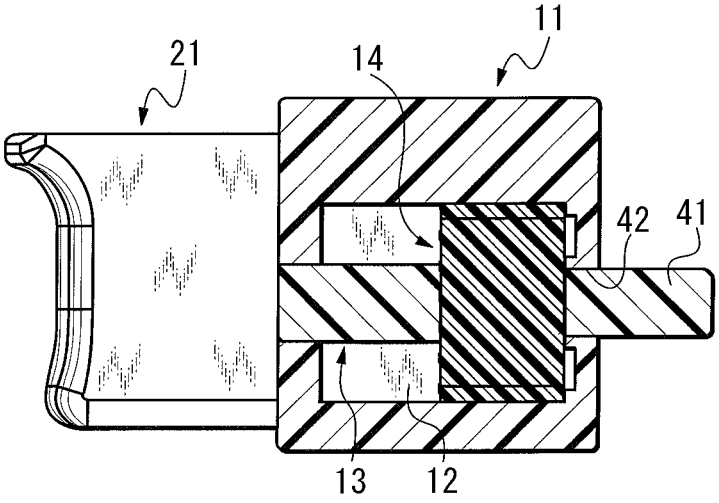
FIG. 10 is a cross-sectional side view illustrating a state in which the trigger of the trigger switch of the sixth embodiment is retracted.

FIG. 9 and FIG. 10 show the trigger switch according to a sixth embodiment of the invention. The trigger switch of the sixth embodiment is provided with a dummy shaft 41 like the plunger 13 in the switch mechanism 14 arranged in the switch chamber 12 in the interior of the case 11, and a shaft hole 42 formed in the side wall on the back of the switch chamber 12 so as to allow the dummy shaft 41 to move in and out according to the movement of the switch mechanism 14, so that an amount of air and air pressure in the interior of the switch chamber is maintained constant.

A radial cross-sectional area of the dummy shaft 41 is substantially the same as a radial cross-sectional area of the plunger. In other words, a portion of the volume of the plunger 13 thrusting into the switch chamber by the operation of the trigger 21 has a compression action on the air in the switch chamber. However, a portion of the dummy shaft 41 corresponding to the volume of the plunger 13 thrusting into the switch chamber protrudes outward from the case 11, and hence the compression action is compensated, so that the amount of air in the switch chamber is maintained constant. In FIGS. 9 and 10, the switch mechanism 14 is roughly illustrated in cross section for the sake of convenience. However, the switch mechanism 14 has a clearance extending in the fore-and-aft direction with respect to the sidewalls of the switch chamber as illustrated in FIG. 7. The same applies also to FIGS. 1 to 6.

In the switch configured in this manner, when the plunger 13 is retracted by an operation of the trigger 21 and the switch mechanism 14 in the switch chamber 12 is moved to compress air in the switch chamber 12, the dummy shaft 41 retracts from the switch chamber 12 through the shaft hole 42 by an amount corresponding to the thrusting plunger 13. Therefore, pressurization or pressure variations by air compressed by the movement of the switch mechanism 14 do not occur.

When an operation to restore the retracted trigger 21 to its original state is performed and hence the switch mechanism 14 in the switch chamber 12 is restored to its original position, air in the switch chamber 12 is not brought into a decompressed state, and hence entry of dust and moisture does not occur.

INDUSTRIAL APPLICABILITY

The trigger switch of the invention may be used widely for electric tools such as electric drills as a switch having high dust-proof properties and waterproof properties.

What is claimed is:

1. A trigger switch comprising:

a switch mechanism;

a case having an end side with a shaft hole formed therein and a switch chamber in which the switch mechanism is arranged;

a plunger inserted into the shaft hole so as to be freely slidable, the plunger having a distal end and a proximal end, the proximal end being coupled to the switch mechanism; and a trigger having a plunger engaging portion engaged with the distal end of the plunger, whereby the trigger switch is operated by moving the switch mechanism via the plunger, wherein the trigger switch includes an air pressure stabilizing mechanism configured to cancel an air compressing action in an interior of the switch chamber caused by the switch mechanism moving in the interior of the switch chamber, wherein the air pressure stabilizing mechanism includes:

a communication hole extending through the plunger along a central axis of the plunger, the communication hole having a proximal end opening facing the switch chamber and a distal end opening on the plunger; and a discharge port formed in the plunger engaging portion of the trigger, the discharge port communicating with the communication hole to release air outside from the communication hole, and wherein the switch mechanism is biased toward the end side of the case with the shaft hole.

2. The trigger switch according to claim 1, further comprising a spherical ball provided in an interior of the communication hole.

3. The trigger switch according to claim 1, further comprising a thin film sheet provided at an end of the communication hole and configured to allow air to pass therethrough and block moisture and dust.

4. The trigger switch according to claim 1, wherein the switch mechanism is sealed.

5. The trigger switch according to claim 1, wherein the plunger engaging portion is locked to the distal end of the plunger.

6. The trigger switch according to claim 1, wherein the trigger switch is operated by moving the switch mechanism via the plunger along the central axis of the plunger.

7. The trigger switch according to claim 1, wherein the discharge port communicates with the communication hole via the distal end opening.

* * * * *